US008033615B2

(12) United States Patent
Hall et al.

(10) Patent No.: US 8,033,615 B2
(45) Date of Patent: Oct. 11, 2011

(54) RETENTION SYSTEM

(75) Inventors: David R. Hall, Provo, UT (US); Scott Dahlgren, Alpine, UT (US); Jonathan Marshall, Provo, UT (US); Italo Elqueta, Lehi, UT (US); Tyson J. Wilde, Spanish Fork, UT (US); Christopher Durrand, Pleasant Grove, UT (US)

(73) Assignee: Schlumberger Technology Corporation, Houston, TX (US)

( * ) Notice: Subject to any disclaimer, the term of this patent is extended or adjusted under 35 U.S.C. 154(b) by 0 days.

(21) Appl. No.: 12/135,714

(22) Filed: Jun. 9, 2008

(65) Prior Publication Data

US 2008/0246329 A1 Oct. 9, 2008

Related U.S. Application Data

(63) Continuation of application No. 12/135,654, filed on Jun. 9, 2008, which is a continuation of application No. 12/135,595, filed on Jun. 9, 2008, which is a (Continued)

(51) Int. Cl.
*E21C 35/197* (2006.01)

(52) U.S. Cl. ..... 299/113

(58) Field of Classification Search ..... 299/79.1, 299/106, 102, 103, 111, 113
See application file for complete search history.

(56) References Cited

U.S. PATENT DOCUMENTS 2,004,315 A 6/1935 Fenn (Continued)

FOREIGN PATENT DOCUMENTS

DE 3431495 A * 3/1986

(Continued)

*Primary Examiner* — John Kreck
(74) *Attorney, Agent, or Firm* — Brinks Hofer Gilson & Lione

(57) ABSTRACT

A retention assembly has a carbide bolster with a first and second segment brazed together, each segment forming at least part of a cavity formed of the bolster. A shaft has an inserted end is interlocked within the cavity.

21 Claims, 16 Drawing Sheets

Related U.S. Application Data

(63) continuation-in-part of application No. 12/112,743, filed on Apr. 30, 2008, which is a continuation-in-part of application No. 12/051,738, filed on Mar. 19, 2008, now Pat. No. 7,669,674, which is a continuation-in-part of application No. 12/051,689, filed on Mar. 19, 2008, which is a continuation of application No. 12/051,586, filed on Mar. 19, 2008, now Pat. No. 7,600,823, which is a continuation-in-part of application No. 12/021,051, filed on Jan. 28, 2008, which is a continuation-in-part of application No. 12/021,019, filed on Jan. 28, 2008, which is a continuation-in-part of application No. 11/971,965, filed on Jan. 10, 2008, now Pat. No. 7,648,210, which is a continuation of application No. 11/947,644, filed on Nov. 29, 2007, which is a continuation-in-part of application No. 11/844,586, filed on Aug. 24, 2007, now Pat. No. 7,600,823, which is a continuation-in-part of application No. 11/829,761, filed on Jul. 27, 2007, now Pat. No. 7,722,127, which is a continuation-in-part of application No. 11/773,271, filed on Jul. 3, 2007, which is a continuation-in-part of application No. 11/766,903, filed on Jun. 22, 2007, which is a continuation of application No. 11/766,865, filed on Jun. 22, 2007, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, which is a continuation-in-part of application No. 11/463,953, filed on Aug. 11, 2006, now Pat. No. 7,464,993, said application No. 12/135,654 is a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770.

(56) References Cited

U.S. PATENT DOCUMENTS

| | | | |
|---|---|---|---|
| 2,124,438 | A | 7/1938 | Struk |
| 3,254,392 | A | 6/1966 | Novkov |
| 3,342,531 | A | 9/1967 | Krekeler |
| 3,342,532 | A | 9/1967 | Krekeler |
| 3,397,012 | A | 8/1968 | Krekeler |
| 3,512,838 | A | 5/1970 | Kniff |
| 3,655,244 | A | 4/1972 | Swisher |
| 3,746,396 | A | 7/1973 | Radd |
| 3,807,804 | A | 4/1974 | Kniff |
| 3,830,321 | A | 8/1974 | McKenry |
| 3,932,952 | A | 1/1976 | Helton |
| 3,945,681 | A | 3/1976 | White |
| 4,005,914 | A | 2/1977 | Newman |
| 4,006,936 | A | 2/1977 | Crabiel |
| 4,098,362 | A | 7/1978 | Bonnice |
| 4,109,737 | A | 8/1978 | Bovenkerk |
| 4,149,753 | A | 4/1979 | Stoltz et al. |
| 4,156,329 | A | 5/1979 | Daniels |
| 4,199,035 | A | 4/1980 | Thompson |
| 4,201,421 | A | 5/1980 | Den Besten |
| 4,247,150 | A | 1/1981 | Wrulich et al. |
| 4,277,106 | A | 7/1981 | Sahley |
| 4,439,250 | A | 3/1984 | Acharya et al. |
| 4,465,221 | A | 8/1984 | Schmidt |
| 4,484,644 | A | 11/1984 | Cook |
| 4,489,986 | A | 12/1984 | Dziak |
| 4,537,448 | A | 8/1985 | Ketterer |
| 4,583,786 | A | 4/1986 | Thorpe et al. |
| 4,627,665 | A | 12/1986 | Ewing et al. |
| 4,678,237 | A | 7/1987 | Collin |
| 4,682,987 | A | 7/1987 | Brady |
| 4,688,856 | A | 8/1987 | Elfgen |
| 4,694,918 | A | 9/1987 | Hall |
| 4,725,098 | A | 2/1988 | Beach |
| 4,729,603 | A | 3/1988 | Elfgen |
| 4,746,379 | A | 5/1988 | Rabinkin |
| 4,765,686 | A | 8/1988 | Adams |
| 4,765,687 | A | 8/1988 | Parrott |
| 4,776,862 | A | 10/1988 | Wiand |
| 4,804,231 | A | 2/1989 | Buljan et al. |
| 4,880,154 | A | 11/1989 | Tank |
| 4,932,723 | A | 6/1990 | Mills |
| 4,940,288 | A | 7/1990 | Stiffler |
| 4,944,559 | A | 7/1990 | Sionnet |
| 4,951,762 | A | 8/1990 | Lundell |
| 5,011,515 | A | 4/1991 | Frushour |
| 5,018,793 | A | 5/1991 | Den Besten |
| 5,112,165 | A | 5/1992 | Hedlund |
| 5,119,714 | A | 6/1992 | Scott et al. |
| 5,141,289 | A | 8/1992 | Stiffler |
| 5,154,245 | A | 10/1992 | Waldenstrom |
| 5,186,892 | A | 2/1993 | Pope |
| 5,251,964 | A | 10/1993 | Ojanen |
| 5,261,499 | A | 11/1993 | Grubb |
| 5,332,348 | A | 7/1994 | Lemelson |
| 5,333,938 | A | 8/1994 | Gale |
| 5,374,111 | A | 12/1994 | Den Besten et al. |
| 5,415,462 | A | 5/1995 | Massa |
| 5,417,475 | A | 5/1995 | Graham |
| 5,447,208 | A | 9/1995 | Lund |
| 5,535,839 | A | 7/1996 | Brady |
| 5,542,993 | A | 8/1996 | Rabinkin |
| 5,653,300 | A | 8/1997 | Lund |
| 5,662,720 | A | 9/1997 | O'Tigheamaigh |
| 5,738,698 | A | 4/1998 | Kapoor |
| 5,823,632 | A | 10/1998 | Burkett |
| 5,837,071 | A | 11/1998 | Andersson et al. |
| 5,842,747 | A | 12/1998 | Winchester |
| 5,845,547 | A | 12/1998 | Sollami |
| 5,875,862 | A | 3/1999 | Jurewicz |
| 5,890,552 | A | 4/1999 | Scott et al. |
| 5,934,542 | A | 8/1999 | Nakamura |
| 5,935,718 | A | 8/1999 | Demo |
| 5,944,129 | A | 8/1999 | Jensen |
| 5,967,250 | A | 10/1999 | Lund |
| 5,992,405 | A | 11/1999 | Sollami |
| 6,000,483 | A | 12/1999 | Jurewicz et al. |
| 6,006,846 | A | 12/1999 | Tibbitts |
| 6,019,434 | A | 2/2000 | Emmerich |
| 6,044,920 | A | 4/2000 | Massa |
| 6,051,079 | A | 4/2000 | Andersson |
| 6,056,911 | A | 5/2000 | Griffin |
| 6,065,552 | A | 5/2000 | Scott |
| 6,113,195 | A | 9/2000 | Mercier |
| 6,170,917 | B1 | 1/2001 | Heinrich |
| 6,193,770 | B1 | 2/2001 | Sung |
| 6,196,636 | B1 | 3/2001 | Mills |
| 6,196,910 | B1 | 3/2001 | Johnson |
| 6,199,956 | B1 | 3/2001 | Kammerer |
| 6,216,805 | B1 | 4/2001 | Lays |
| 6,270,165 | B1 | 8/2001 | Peay |
| 6,341,823 | B1 | 1/2002 | Sollami |
| 6,354,771 | B1 | 3/2002 | Bauschulte |

| | | | |
|---|---|---|---|
| 6,364,420 | B1 | 4/2002 | Sollami |
| 6,371,567 | B1 | 4/2002 | Sollami |
| 6,375,272 | B1 | 4/2002 | Ojanen |
| 6,419,278 | B1 | 7/2002 | Cunningham |
| 6,460,637 | B1 | 10/2002 | Siracki et al. |
| 6,478,383 | B1 | 11/2002 | Ojanen |
| 6,499,547 | B2 | 12/2002 | Scott et al. |
| 6,517,902 | B2 | 2/2003 | Drake |
| 6,585,326 | B2 | 7/2003 | Sollami |
| 6,601,662 | B2 | 8/2003 | Matthias et al. |
| 6,651,758 | B2 | 11/2003 | Xiang et al. |
| 6,685,273 | B1 | 2/2004 | Sollami |
| 6,692,083 | B2 | 2/2004 | Latham |
| 6,702,393 | B2 | 3/2004 | Mercier |
| 6,709,065 | B2 | 3/2004 | Peay |
| 6,719,074 | B2 | 4/2004 | Tsuda |
| 6,732,914 | B2 | 5/2004 | Cadden |
| 6,733,087 | B2 | 5/2004 | Hall et al. |
| 6,739,327 | B2 | 5/2004 | Sollami |
| 6,758,530 | B2 | 7/2004 | Sollami |
| 6,786,557 | B2 | 9/2004 | Montgomery, Jr. |
| 6,824,225 | B2 | 11/2004 | Stiffler |
| 6,854,810 | B2 | 2/2005 | Montgomery, Jr. |
| 6,861,137 | B2 | 3/2005 | Griffin |
| 6,889,890 | B2 | 5/2005 | Yamazaki |
| 6,962,395 | B2 | 11/2005 | Mouthaan |
| 6,966,611 | B1 | 11/2005 | Sollami |
| 6,994,404 | B1 | 2/2006 | Sollami |
| 7,204,560 | B2 | 4/2007 | Mercier |
| 7,369,743 | B2 | 5/2008 | Noro |
| 7,387,345 | B2 | 6/2008 | Hall et al. |
| 7,390,066 | B2 | 6/2008 | Hall et al. |
| 7,413,258 | B2 | 8/2008 | Hall et al. |
| 2003/0209366 | A1 | 11/2003 | McAlvain |
| 2003/0230926 | A1 | 12/2003 | Mondy |
| 2004/0026983 | A1 | 2/2004 | McAlvain |
| 2006/0237236 | A1 | 10/2006 | Sreshta et al. |
| 2006/0261663 | A1 | 11/2006 | Sollami |

FOREIGN PATENT DOCUMENTS

| | | | | |
|---|---|---|---|---|
| DE | 3500261 | | | 7/1986 |
| DE | 3818213 | | | 11/1989 |
| DE | 4039217 | A | * | 6/1992 |
| DE | 19821147 | | | 11/1999 |
| DE | 10163717 | | | 5/2003 |
| EP | 0412287 | A2 | | 2/1991 |
| EP | 1186744 | A1 | | 3/2002 |
| EP | 1574309 | A | * | 9/2005 |
| GB | 2004315 | | | 3/1979 |
| GB | 2037223 | | | 11/1979 |
| JP | 5280273 | | | 10/1993 |

* cited by examiner

XX

RETENTION SYSTEM

CROSS REFERENCE TO RELATED APPLICATIONS

This application is a continuation of U.S. patent application Ser. No. 12/135,654, filed on Jun. 9, 2008, which is a continuation of U.S. patent application Ser. No. 12/135,595, filed on Jun. 9, 2008, which is a continuation-in-part of U.S. patent application Ser. No. 12/112,743, filed on Apr. 30, 2008, which is a continuation-in-part of U.S. patent application Ser. No. 12/051,738, filed on Mar. 19, 2008, which is a continuation-in-part of U.S. patent application Ser. No. 12/051,689, filed on Mar. 19, 2008, which is a continuation of U.S. patent application Ser. No. 12/051,586, filed on Mar. 19, 2008, which is a continuation-in-part of U.S. patent application Ser. No. 12/021,051, filed on Jan. 28, 2008, which is a continuation-in-part of U.S. patent application Ser. No. 12/021,019, filed on Jan. 28, 2008, which is a continuation-in-part of U.S. patent application Ser. No. 11/971,965, filed on Jan. 10, 2008 and issued as U.S. Pat. No. 7,648,210, which is a continuation of U.S. patent application Ser. No. 11/947,644, filed on Nov. 29, 2007, which is a continuation-in-part of U.S. patent application Ser. No. 11/844,586, filed on Aug. 24, 2007 and issued as U.S. Pat. No. 7,600,823. U.S. patent application Ser. No. 11/844,586 is a continuation-in-part of U.S. patent application Ser. No. 11/829,761, filed on Jul. 27, 2007 and issued as U.S. Pat. No. 7,722,127. U.S. patent application Ser. No. 11/829,761 is a continuation-in-part of U.S. patent application Ser. No. 11/773,271 filed on Jul. 3, 2007. U.S. patent application Ser. No. 11/773,271 is a continuation-in-part of U.S. patent application Ser. No. 11/766,903 filed on Jun. 22, 2007. U.S. patent application Ser. No. 11/766,903 is a continuation of U.S. patent application Ser. No. 11/766,865 filed on Jun. 22, 2007. U.S. patent application Ser. No. 11/766,865 is a continuation-in-part of U.S. patent application Ser. No. 11/742,304 filed on Apr. 30, 2007 and issued as U.S. Pat. No. 7,475,948. U.S. patent application Ser. No. 11/742,304 is a continuation of U.S. patent application Ser. No. 11/742,261 filed on Apr. 30, 2007 and issued as U.S. Pat. No. 7,469,971. U.S. patent application Ser. No. 11/742,261 is a continuation-in-part of U.S. patent application Ser. No. 11/464,008 filed on Aug. 11, 2006 and issued as U.S. Pat. No. 7,338,135. U.S. patent application Ser. No. 11/464,008 is a continuation-in-part of U.S. patent application Ser. No. 11/463,998 filed on Aug. 11, 2006 and now U.S. Pat. No. 7,384,105. U.S. patent application Ser. No. 11/463,998 is a continuation-in-part of U.S. patent application Ser. No. 11/463,990 filed on Aug. 11, 2006 and issued as U.S. Pat. No. 7,320,505. U.S. patent application Ser. No. 11/463,990 is a continuation-in-part of U.S. patent application Ser. No. 11/463,975 filed on Aug. 11, 2006 and issued as U.S. Pat. No. 7,445,294. U.S. patent application Ser. No. 11/463,975 is a continuation-in-part of U.S. patent application Ser. No. 11/463,962 filed on Aug. 11, 2006 and issued as U.S. Pat. No. 7,413,256. U.S. patent application Ser. No. 11/463,962 is a continuation-in-part of U.S. patent application Ser. No. 11/463,953 filed on Aug. 11, 2006 and issued as U.S. Pat. No. 7,464,993. The present application is also a continuation-in-part of U.S. patent application Ser. No. 11/695,672 filed on Apr. 3, 2007 and issued as U.S. Pat. No. 7,396,086. U.S. patent application Ser. No. 11/695,672 is a continuation-in-part of U.S. patent application Ser. No. 11/686,831 filed on Mar. 15, 2007 and issued as U.S. Pat. No. 7,568,770. All of these applications are herein incorporated by reference for all that they contain.

BACKGROUND OF THE INVENTION

In the road construction and mining industries, rocks and pavement are degraded using attack tools. Often, a drum with an array of attack tools attached to it may be rotated and moved so that the attack tools engage a paved surface or rock to be degraded. Because attack tools engage materials that may be abrasive, the attack tools may be susceptible to wear.

U.S. Pat. No. 6,733,087 to Hall et al., which is herein incorporated by reference for all that it contains, discloses an attack tool for working natural and man-made materials that is made up of one or more segments, including a steel alloy base segment, an intermediate carbide wear protector segment, and a penetrator segment comprising a carbide substrate that is coated with a super hard material. The segments are joined at continuously curved interfacial surfaces that may be interrupted by grooves, ridges, protrusions, and posts. At least a portion of the curved surfaces vary from one another at about their apex in order to accommodate ease of manufacturing and to concentrate the bonding material in the region of greatest variance.

Examples of degradation assemblies from the prior art are disclosed in U.S. Pat. No. 6,824,225 to Stiffler; U.S. Patent Publication No. 2005/0173966 to Mouthaan; U.S. Pat. No. 6,692,083 to Latham; U.S. Pat. No. 6,786,557 to Montgomery, Jr.; U.S. Patent Publication No. 2003/0230926 to Mondy; U.S. Pat. No. 4,932,723 to Mills; U.S. Patent Publication No. 2002/0175555 to Merceir; U.S. Pat. No. 6,854,810 to Montgomery, Jr.; and U.S. Pat. No. 6,851,758 to Beach, which are all herein incorporated by reference for all they contain.

BRIEF SUMMARY OF THE INVENTION

In one aspect of the invention a retention assembly has a carbide bolster comprising a cavity formed in its base end. A shaft comprises an inserted end disposed within the cavity. The shaft is disposed within a hollow shank which comprises a first end contacting the bolster and a loaded end in mechanical communication with the shaft and the inserted end is brazed to an inner surface of the cavity.

The shaft may be in mechanical communication with the loaded end through a threaded nut. The threaded nut may engage a shoulder of the shank. The brazed joint may comprise a braze material comprising copper, brass, lead, tin, silver or combinations thereof. The inserted end of the shaft may be interlocked inside the cavity. The shaft, the carbide bolster and the shank may be coaxial. The inserted end of the shaft may be brazed with the inner surface of the cavity of the bolster. The inserted end of the shaft may be adapted to compliment the ceiling of the bolster. The cavity may comprise a concave surface adapted to receive the shaft. The retention assembly may be incorporated into drill bits, shear bits, cone crushers, picks, hammer mills or combinations thereof. The cavity of the bolster may comprise a thermal expansion relief groove. The interface between the inserted end of the shaft and the bolster may be non-planar. The inserted end of the shaft may comprise a 1 to 15 degree taper. The inserted end of the shaft may comprise at least one thermal expansion relief groove. The thermal expansion relief grooves in the inserted end of the shaft may be adapted to receive the thermal expansion relief grooves in the cavity of the bolster. The inserted end of the shaft may be brazed to a top of the cavity. A tip made of carbide and diamond may be brazed to the bolster. An insert may be brazed into the cavity and the insert may retain the inserted end of the shaft. The insert and the inserted end may comprise a rounded interface. The retention assembly may be incorporated into a driving mechanism, a drum, a chain, or combinations thereof. The bolster may comprise an assembly brazed into the cavity and the assembly may comprise a pocket adapted to hold the inserted portion of the shaft.

In another aspect of the invention a retention assembly has a carbide bolster comprising a cavity formed in its base end. A shaft comprises an inserted end disposed within the cavity. The shaft is disposed within a hollow shank which comprises a first end contacting the bolster and a loaded end in mechanical communication with the shaft and the inserted end is interlocked within the geometry of the cavity by a casting.

The cast material may comprise metals like zinc, aluminum, magnesium; thermosetting plastics, Bakelite, melamine resin, polyester resin, vulcanized rubber or combination thereof. The shaft may be in mechanical communication with the loaded end through a threaded nut. The threaded nut may engage a shoulder of the shank. The inserted end of the shaft may comprise a 1 to 15 degree taper. The inserted end of the shaft may comprise an increase in diameter. The shaft, the carbide bolster and the shank may be coaxial. The inserted end of the shaft may compromise at least one groove formed in its surface. The retention assembly may be incorporated into drill bits, shear bits, hammer mills, cone crushers, or combinations thereof.

The inserted end of the shaft may compromise a shaft geometry adapted to interlock with the casting. The inner surface of the cavity of the bolster may comprise a cavity geometry adapted to interlock with the casting. The cavity geometry may comprise a taper narrowing towards an opening of the cavity formed in the base end. The diameter of the opening of the cavity formed in the base end is slightly smaller than the diameter of a tapered end of the shaft. The cavity geometry may comprise a lip. The inserted end of the shaft may be in contact with the cavity of the bolster. A tip of carbide and diamond may be brazed to the bolster. The retention assembly may be incorporated into a driving mechanism, a drum, a chain, a rotor, or combination thereof. The casting may submerge at least the tapered end of the shaft.

DETAILED DESCRIPTION OF THE INVENTION AND THE PREFERRED EMBODIMENT

It will be readily understood that the components of the present invention, as generally described and illustrated in the Figures herein, may be arranged and designed in a wide variety of different configurations. Thus, the following more detailed description of embodiments of the methods of the present invention, as represented in the Figures is not intended to limit the scope of the invention, as claimed, but is merely representative of various selected embodiments of the invention.

The illustrated embodiments of the invention will best be understood by reference to the drawings, wherein like parts are designated by like numerals throughout. Those of ordinary skill in the art will, of course, appreciate that various modifications to the methods described herein may easily be made without departing from the essential characteristics of the invention, as described in connection with the Figures. Thus, the following description of the Figures is intended only by way of example, and simply illustrates certain selected embodiments consistent with the invention as claimed herein.

Figure 1:
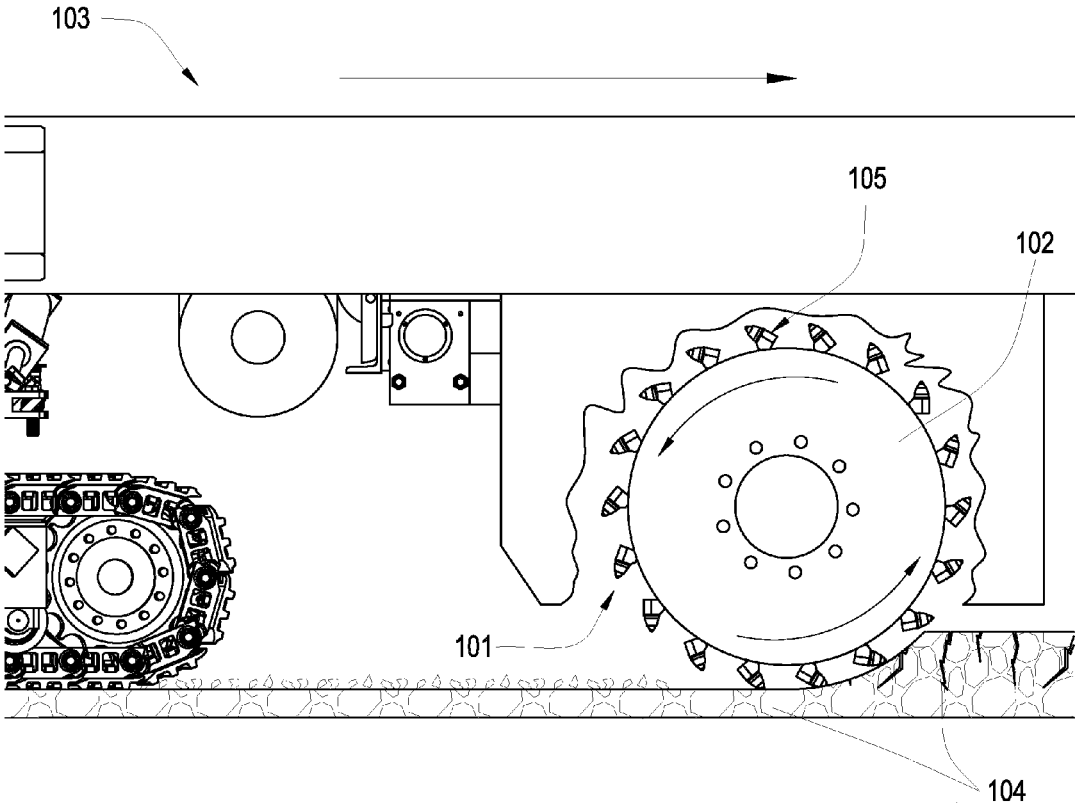
FIG. 1 is a cross-sectional diagram of an embodiment of a plurality of picks suspended underside of a pavement milling machine.

FIG. 1 is a cross-sectional diagram of an embodiment of a plurality of picks 101 attached to a rotating drum 102 connected to the underside of a pavement milling machine 103. The milling machine 103 may be a cold planer used to degrade man-made formations such as pavement 104 prior to the placement of a new layer of pavement. Picks 101 may be attached to the drum 102 bringing the picks 101 into engagement with the formation.

Figure 2:
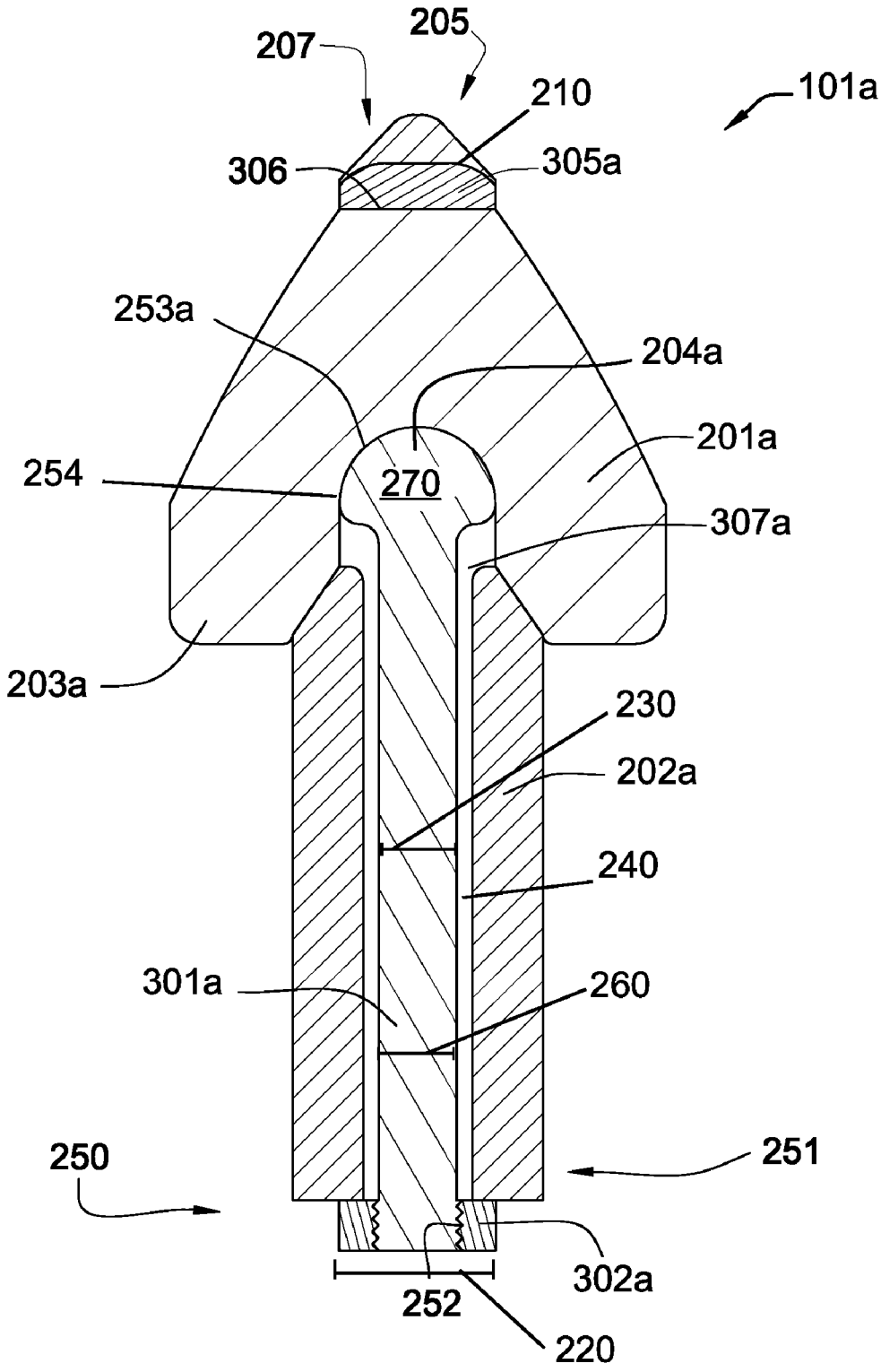
FIG. 2 is a cross-sectional diagram of an embodiment of a pick.

FIG. 2 is an orthogonal diagram of an embodiment of a pick 101*a*. The pick 101*a* comprises a cemented metal carbide bolster 201*a* attached to a hollow shank 202*a* at a base end 203*a* of the carbide bolster 201*a*. The hollow shank 202*a* has a bore 240 with a diameter 260. The carbide bolster 201*a* may comprise tungsten carbide, calcium carbide, silicon carbide, cementite, boron carbide, tantalum carbide, titanium carbide or combination thereof. The shank 202*a* may be substantially cylindrical and/or tapered.

An impact tip 205 may comprise a super hard material 207 bonded to a carbide substrate 305*a* at a non-planar interface 210. Preferably the carbide substrate 305*a* has an axial thickness less than 6 mm. In some embodiments, the carbide substrate 305*a* ranges between 10 and 1 mm. The superhard material 207 may be at least 0.100 inches thick axially, in some embodiments it may be over 0.250 inches. The superhard material 207 may be formed in a substantially conical shape.

Typically the carbide substrate 305*a* of the impact tip 205 is brazed to the carbide bolster 201*a* at a planar interface 306. The impact tip 205 and the carbide bolster 201 may be brazed together with a braze material comprising a melting temperature from 700 to 1200 degrees Celsius. The super hard material 207 may be bonded to the carbide substrate 305*a* through a high-temperature/high-pressure process (HTHP).

The super hard material 207 may comprise diamond, polycrystalline diamond with a binder concentration of 1 to 40 weight percent, cubic boron nitride, refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide, monolithic diamond, polished diamond, course diamond, fine diamond, nonmetal catalyzed diamond, cemented metal carbide, chromium, titanium, aluminum, tungsten, or combinations thereof.

A cavity 307*a* may be formed at the base end 203*a* of the bolster 201*a*. An inserted end 204*a* of a shaft 301*a* may be inserted into the cavity 307*a*. An other end 250 of the shaft 301*a* may be in mechanical communication with a loaded end 251 of the shank 202*a*. The other end 250*a* of the shaft 301*a* may comprise at least one thread 252 adapted to receive a threaded nut 302*a*. A threaded nut diameter 220 may be bigger than a shaft diameter 230 but smaller than the bore diameter 260.

The inserted end 204*a* of the shaft 301*a* may be brazed within the cavity 307*a* of the carbide bolster 201*a*. Preferably, a head 270 of the inserted end 204*a* comprises a geometry that compliments a geometry of the cavity 307*a*. Preferably, the head 270 of the inserted end 204*a* is brazed directly to a ceiling 253*a* of the cavity 307*a*. In other embodiments, the shaft 301*a* is brazed to a side wall 254 of the cavity 307*a*.

Figure 3:
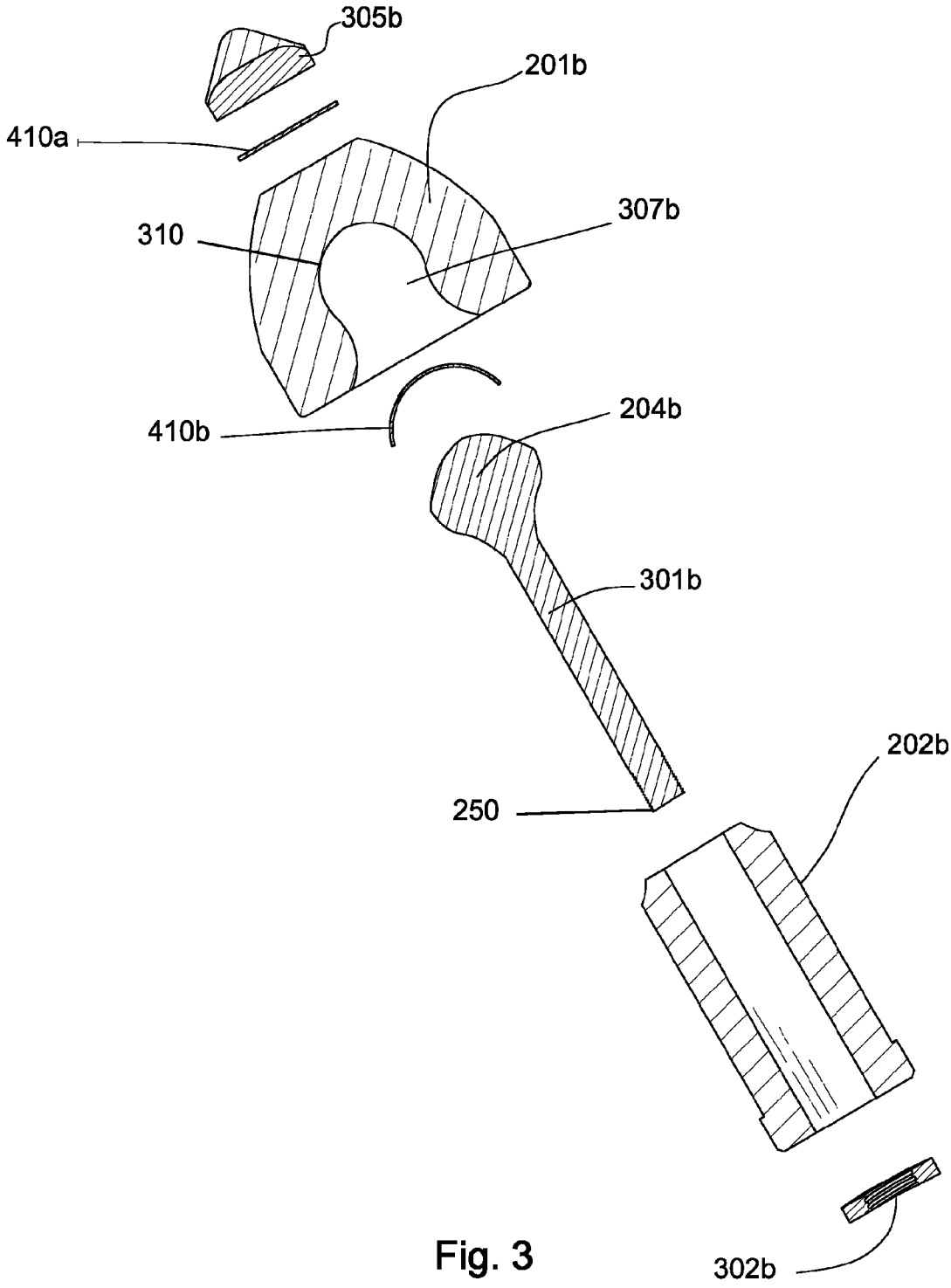
FIG. 3 is an exploded diagram of an embodiment of a pick.

Referring now to the embodiment of FIG. 3, a carbide substrate 305*b* and a carbide bolster 201*b* may be brazed together at high temperature at the same time an inserted end 204*b* of a shaft 301*b* is brazed to a cavity 307*b*. The shaft 301*b* and the cavity 307*b* may be brazed at a non-planar interface 310. In some embodiments, the braze joints may be brazed at different times. In some embodiments, both braze joints utilize substantially similar braze materials 410*a* and 410*b*.

After brazing the inserted end 204*b* of the shaft 301*b* into the cavity 307*b*, an other end 250*b* of the shaft 301*b* may be tensioned through a hollow shank 202*b* and anchored while under tension with a threaded nut 302*b*. This tension loads the inserted end 204*b* of the shaft 301*b* and snuggly holds the carbide bolster 201*b* against the hollow shank 202*b*.

Figure 4:
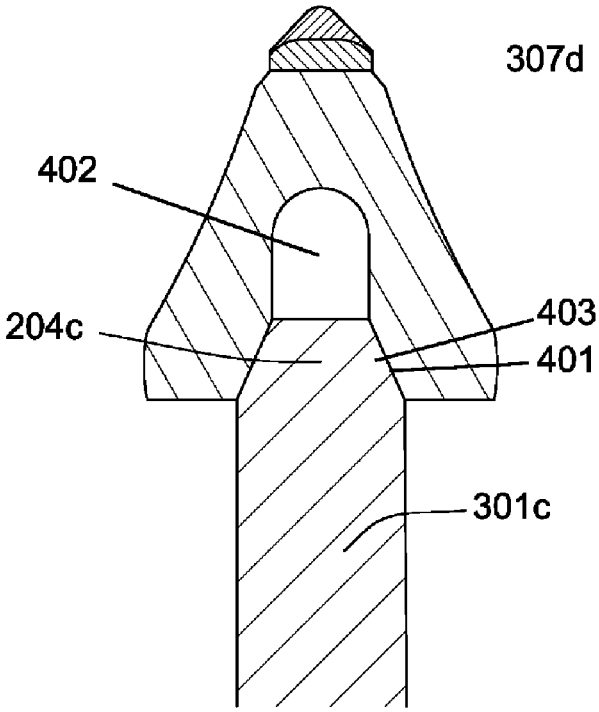
FIG. 4 is a cross-sectional diagram of an embodiment of a pick.

In the embodiment of FIG. 4, an inserted end 204*c* of a shaft 301*c* is tapered at shaft taper 403, which is adapted to abut a cavity taper 401 of a cavity 402. The shaft taper 403 and the cavity taper 401 may be brazed together.

Figure 5:
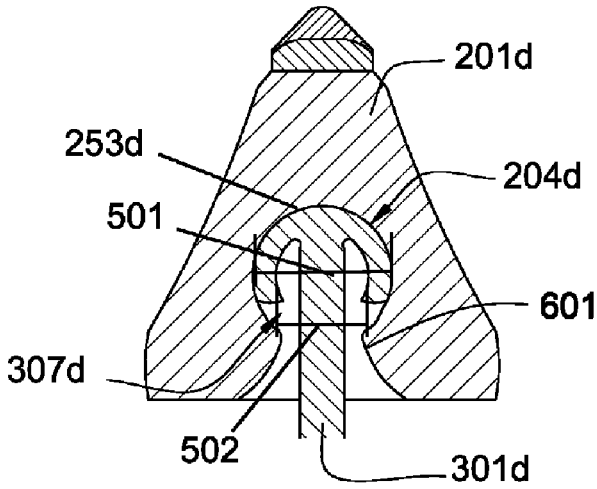
FIG. 5 is a cross-sectional diagram of another embodiment of a pick.

In the embodiment of FIG. 5, an inserted end 204*d* of a shaft 301*d* is brazed to a ceiling 253*d* of a cavity 307*d*. A diameter 501 of the inserted end 204*d* is larger than a diameter 502 of an opening constricted by a protruding lip 601 formed in the cavity 307*d*. The geometry of the inserted end 204*d* is adapted to flex upon insertion and snap out once past the lip 601. The inserted end 204*d* of the shaft 301*d* may be interlocked inside the cavity 307*d* of the carbide bolster 201*d*. The geometry of the inserted end 204*d* of the shaft 301*d* may allow enough space for thermal expansion while brazing the inserted end 301*d* to the cavity 307*d*.

Figure 6:
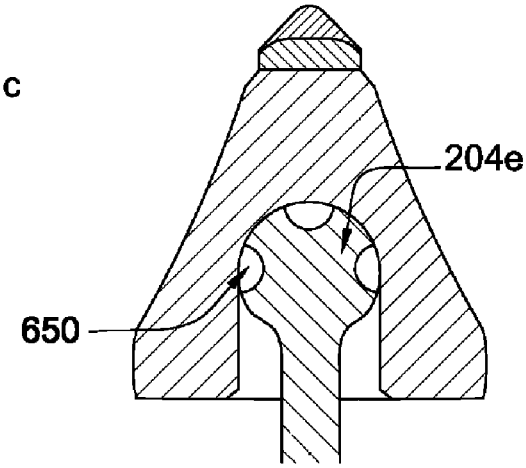
FIG. 6 is a cross-sectional diagram of another embodiment of a pick.

Referring now to the embodiment of FIG. 6, an inserted end 204*e* of the shaft 301*e* may comprise at least one relief groove 650 to allow space for thermal expansion during brazing. This may reduce residual stress that may develop during brazing.

Figure 7:
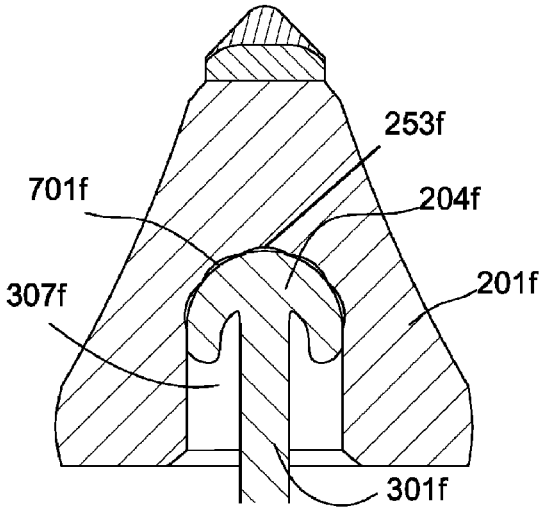
FIG. 7 is a cross-sectional diagram of another embodiment of a pick.

Referring now to the embodiment of FIG. 7, a ceiling 253*f* of the cavity 307*f* of a carbide bolster 201*f* may comprise at least one relief groove 701*f* to allow for thermal expansion during brazing. The relief groove 701*f* may reduce residual stress that may develop during brazing. An inserted end 204*f* of a shaft 301*f* may be partially brazed to the ceiling 253*f* of the cavity 307*f* of the carbide bolster 201*f*.

Figure 8:
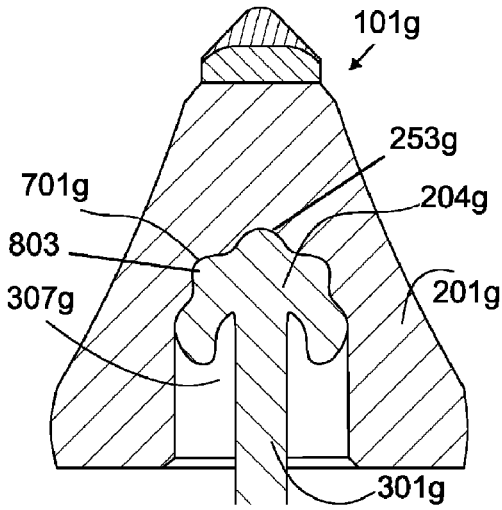
FIG. 8 is a cross-sectional diagram of another embodiment of a pick.

In FIG. 8 another embodiment of the invention is disclosed in which a pick 101*g* may comprise at least one groove 701*g* in a ceiling 253*g* of a cavity 307*g* of a carbide bolster 201*g* adapted to receive protrusions 803 in an inserted end 204*g* of a shaft 301*g*. The ceiling 253*g* may be irregular and non-planar. The grooves 701*g* may form an interlocking mechanism with the protrusion 803. The grooves 701*g* may increase the surface area of the inserted end 204*g* and ceiling 253*g* allowing a larger braze joint.

Figure 9:
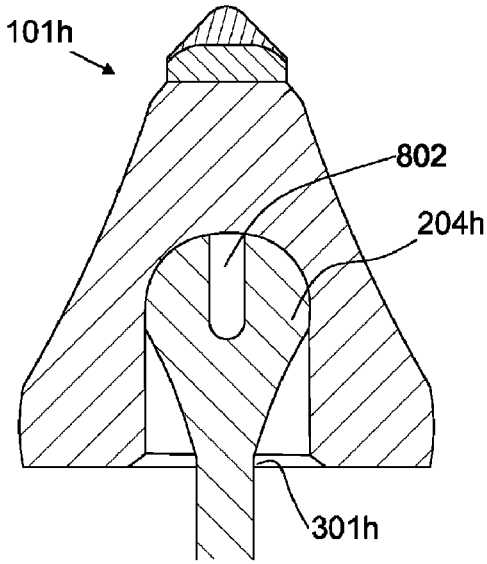
FIG. 9 is a cross-sectional diagram of another embodiment of a pick.

FIG. 9 is a cross-sectional diagram of another embodiment of a pick 101*h*. A relief opening 802 may be formed in an inserted end 204*h* of a shaft 301*h*. The purpose of the relief opening 802 may be to allow enough space for thermal expansion while brazing.

Figure 10:
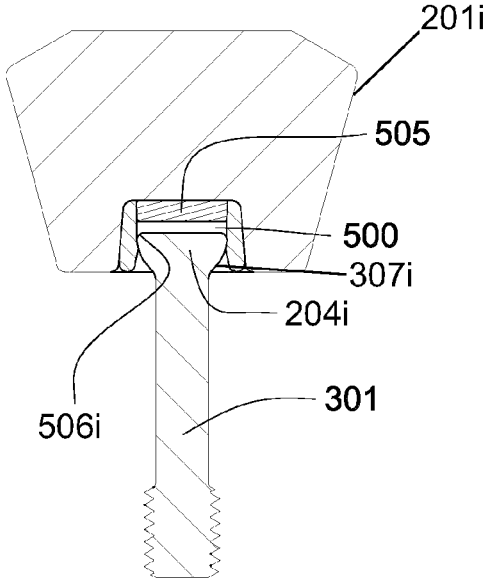
FIG. 10 is a cross sectional diagram of an embodiment of an insert brazed in a cavity.

Referring now to FIG. 10, an insert 506*i* may be brazed into a cavity 307*i* of a carbide bolster 201*i*. The insert 506*i* may be adapted to retain an inserted end 204*i* of a shaft 301*i*, preferably in ball and socket type of joint, although in some embodiments the joint may be tapered or interlocked. A cap 505 may be used in some embodiment to prevent a brazing material from flowing into the insert 506*i* and interfering with the joint. The solidification of the brazing material may restrict the compliancy of the joint during a bending moment induced in the carbide bolster 201*i* while in operation and create stress risers. The insert 506*i* and the inserted end 204*i* of the shaft 301*i* may comprise a rounded interface.

Figure 11:
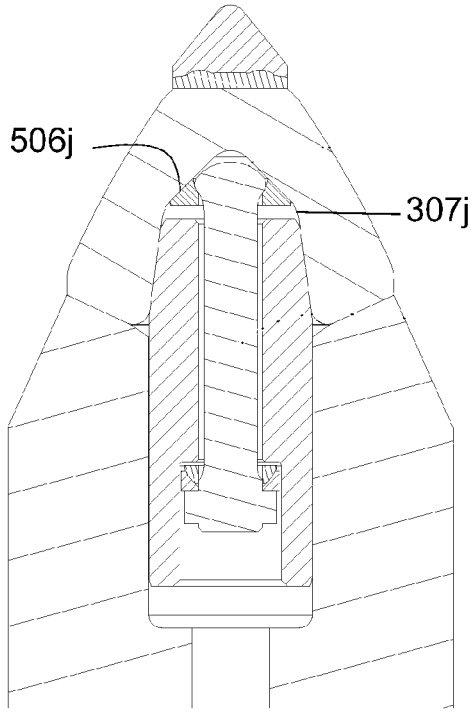
FIG. 11 is a perspective diagram of another embodiment of an insert brazed in the cavity.

In FIG. 11, another embodiment of an insert 506*j* brazed within a cavity 307*j* is shown.

Figure 12:
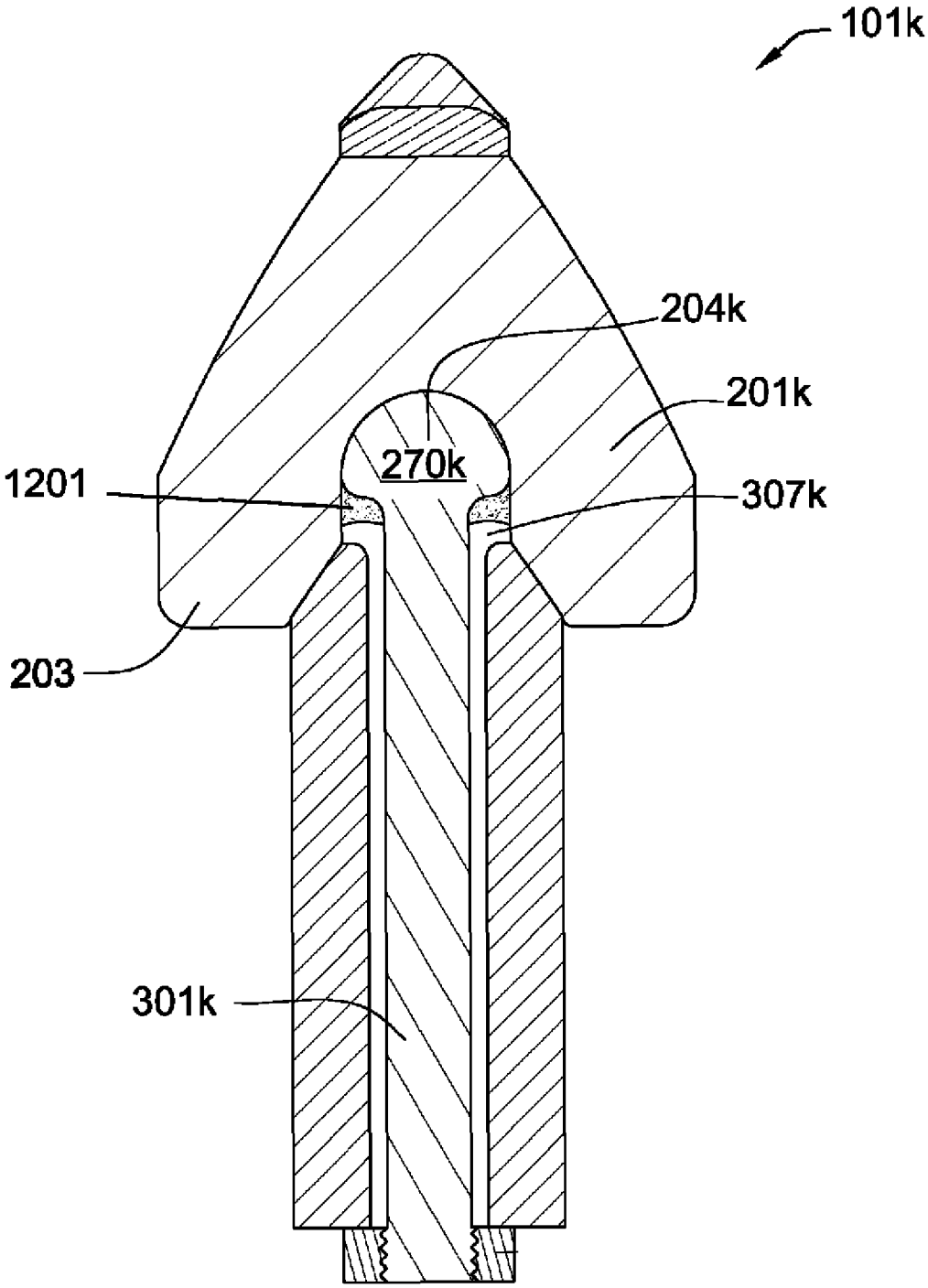
FIG. 12 is a cross-sectional diagram of another embodiment of a pick.

FIG. 12 is a cross-sectional diagram of another embodiment of a pick 101*k*. An inserted end 204*k* of a shaft 301*k* may be interlocked within a cavity 307*k* of a carbide bolster 201*k* by a cast material 1201. The casting cast material 1201 may comprise zinc, a braze material, a plastic, lead, or combinations thereof. Zinc may be the preferred cast material since zinc will not significantly bond to the carbide and zinc demonstrates a high compressive strength. In some embodiment a non-wetting agent may be applied to a head 270*k* of the shaft 301*k* to prevent the zinc from forming a strong bond with the head 270*k* of the shaft 301*k*.

Figure 13:
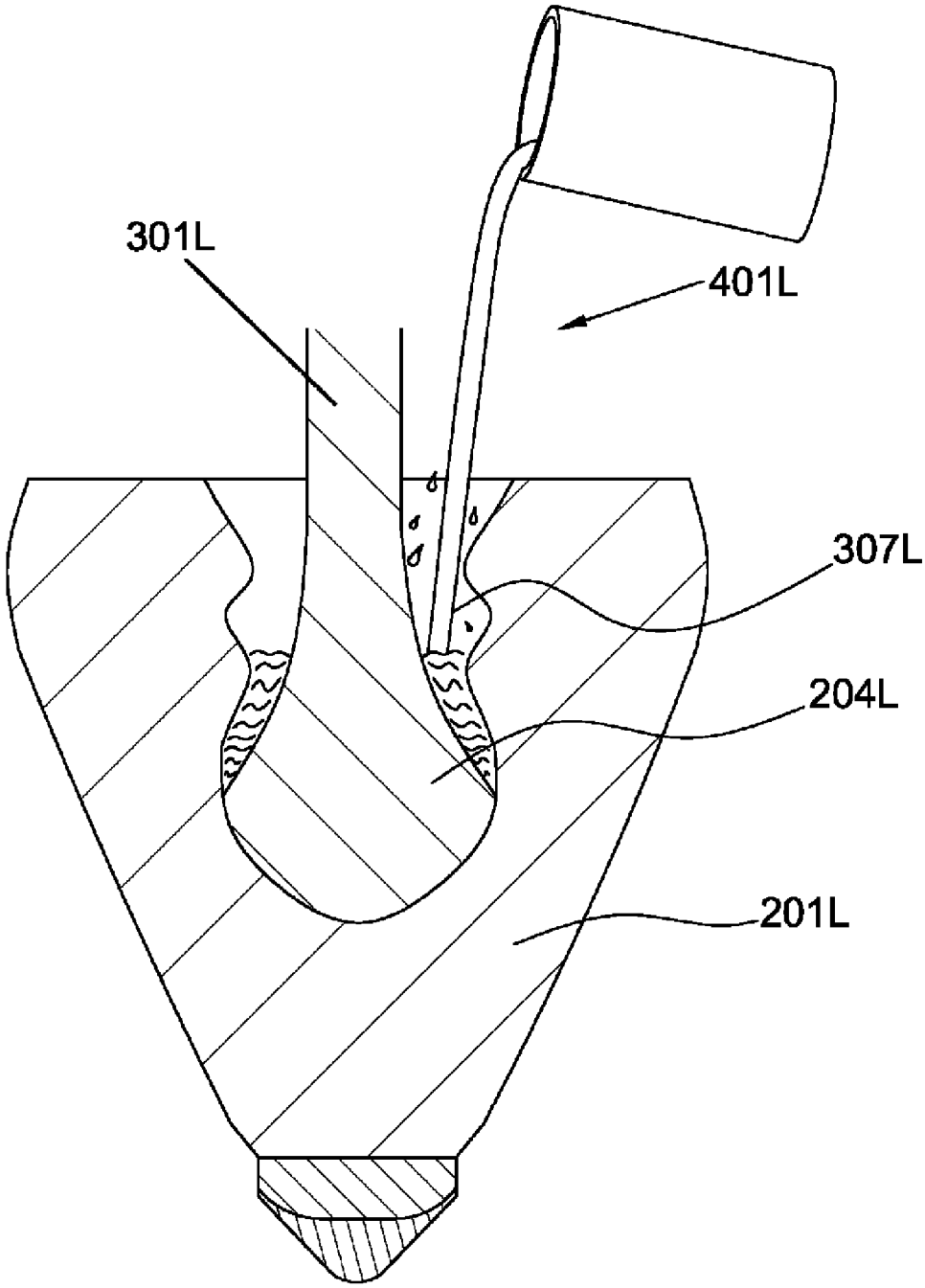
FIG. 13 is a cross-sectional diagram of an embodiment of a casting process.

In FIG. 13, a cross-sectional diagram of an embodiment depicting a casting process is shown. A tapered inserted end 204*l* of a shaft 301*l* may be brought into a cavity 307*l* and molten cast material 401*l* may be poured inside the cavity 307*l*. The molten cast material 401*l* may be left to be cooled and solidify. The cooling rate may vary according to the cast material 401*l*. The rate at which a cast material 401*l* cools may affect its the microstructure, quality, and properties of the cast material 401*l* and the mechanical interlocking of the cast material 401*l* with the shaft 301*l* and the geometry of the cavity 307*l*. The geometry of the cavity 307*l* of the carbide bolster 201*l* may provide additional support in keeping the inserted end 204*l* of the shaft 301*l* interlocked within the cavity 307*l*.

In other embodiments, casting material granules, balls, shavings, segments, dust or combinations thereof may be placed in the cavity 307*l* with the inserted end 204*l* of the shaft 301*l* and melted in place. The cast material 401*l* may be heated in an oven, or a heating source such as a torch or radiant heater may be applied within the cavity 307*l* or applied to the outside of the carbide bolster 201*l*.

Figure 14:
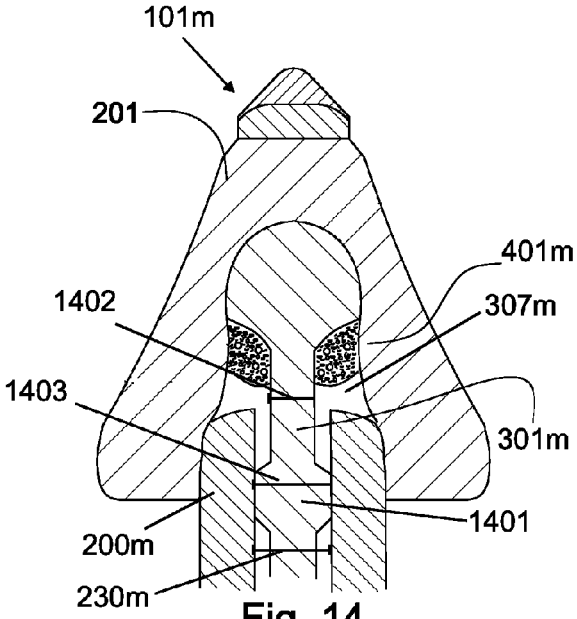
FIG. 14 is a cross-sectional diagram of another embodiment of a pick.

FIG. 14 is another embodiment of a pick 101*m*. A shaft 301*m* is disposed in a cavity 307*m* with cast material 401*m* cast within the cavity 307*m* proximate the shaft 301*m*. The shaft 301*m* includes a first diameter 1402 and a second diameter 1403*a* with the second diameter 1403*a* adapted to substantially contact an inner diameter 230*m* of a hollow shank 202*m*.

Figure 15:
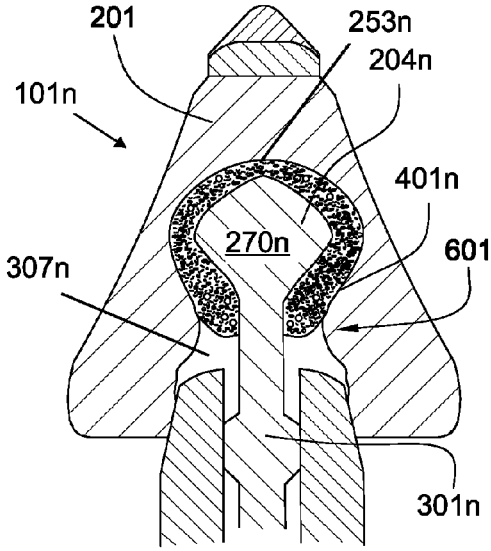
FIG. 15 is a cross-sectional diagram of another embodiment of a pick.

FIG. 15 is a cross-sectional diagram of another embodiment of a pick 101*n*. An inserted end 204*n* of a shaft 301*n* may or may not touch a ceiling 253*n* of the cavity 307*n*. The cast material 401*n* may form around an entire surface of a head 270*n* of the inserted end 204*n*.

Figure 16:
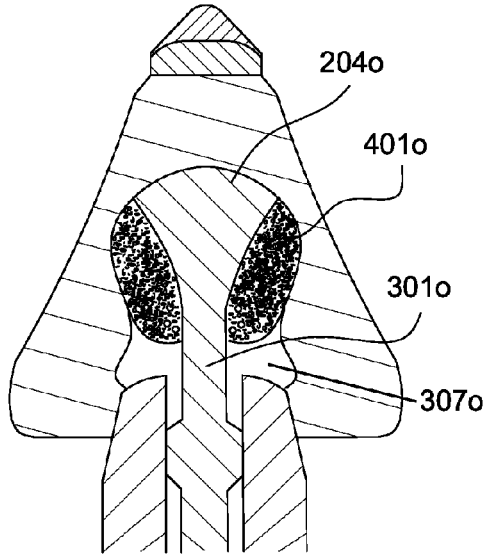
FIG. 16 is a cross-sectional diagram of another embodiment of a pick.

In the embodiment of FIG. 16, an inserted end 204*o* of a shaft 3010 may be tapered to increase its surface area with the cast material 401*o*. In some embodiments, the taper is gradual and distributes the load substantially equally across an interface between the cast material 401*o* and the inserted end 104*o*. Another benefit of casting the cast material 4010 with a shaft 301*o* in place is distributing the loads across substantially the entire inner surface of a cavity 307*o*.

Figure 17:
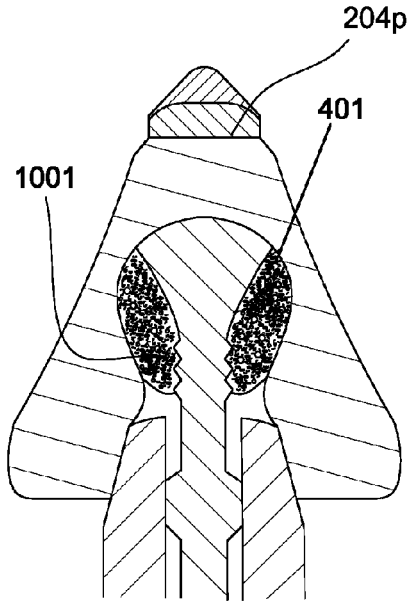
FIG. 17 is a cross-sectional diagram of another embodiment of a pick.

Referring now to the embodiment of FIG. 17, an inserted end 204*p* may comprise at least one groove 1001, and may be tapered. The groove 1001 may increase the grip between the inserted end 204*p* and the cast material 401*p*.

Figure 18:
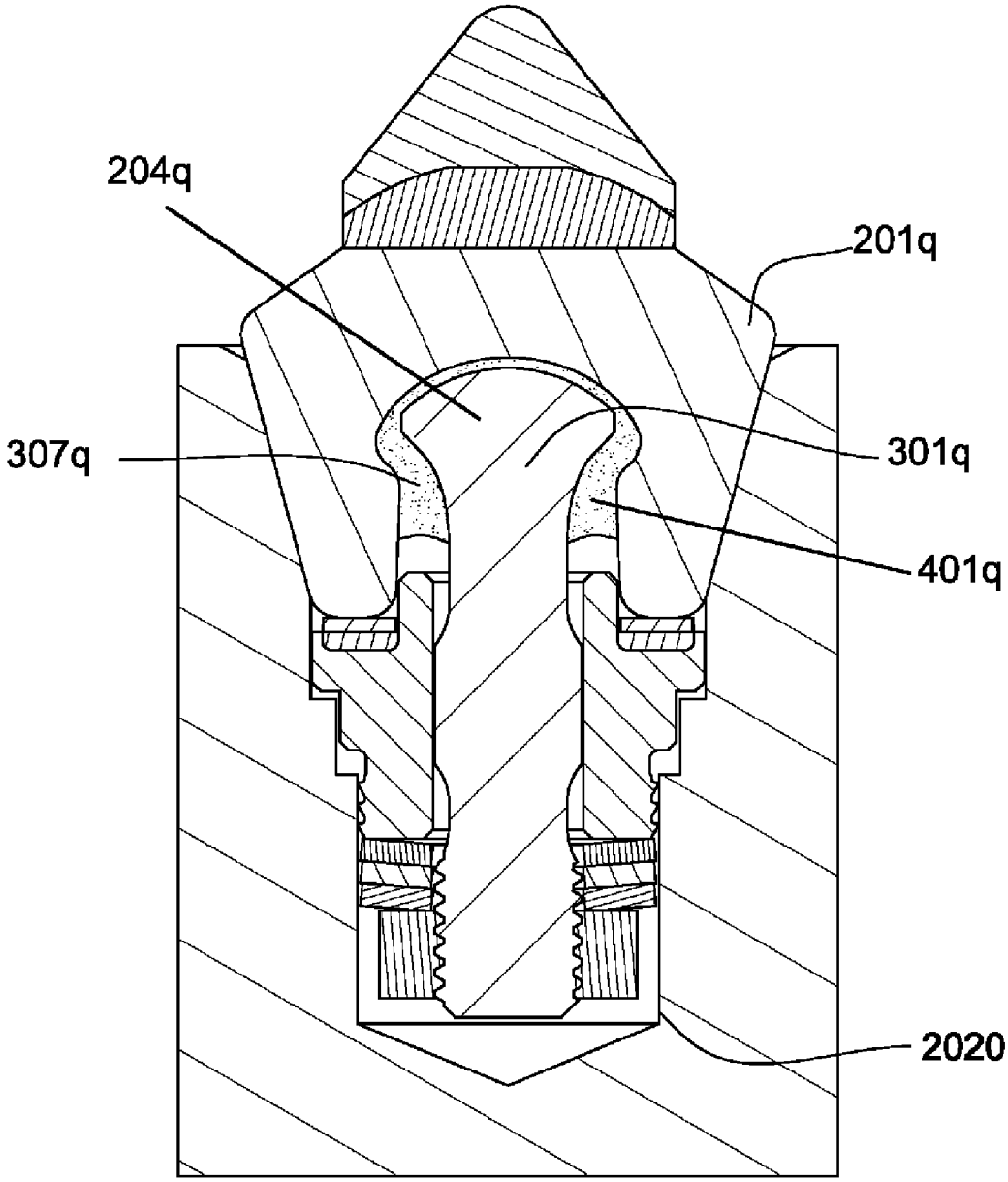
FIG. 18 is a cross-sectional diagram of an embodiment of a retention assembly.

FIG. 18 is a cross-sectional diagram of an embodiment of a degradation assembly inserted into a blind hole 2020 of a tool, such as a fixed cutter drill bit, percussion bit, roller cone bit, miller, crusher and/or mill. An inserted end 204*q* of a shaft 301*q* may be brought together with a cavity 307*q* of a bolster 201*q* by a cast material 401*q*.

Figure 19:
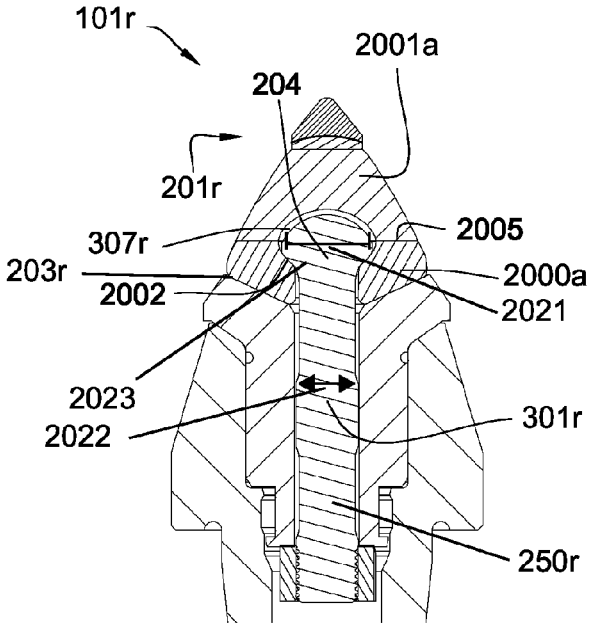
FIG. 19 is a cross-sectional diagram of another embodiment of a pick.

FIG. 19 is another embodiment of a pick 101*r*. The carbide bolster 201*r* comprises a first segment 2000*a* and a second segment 2001*a*. Since carbide is a brittle material and shaft 301*r* is tensioned and therefore loading at least a portion of the carbide bolster 201*r*, a thick carbide lip 2002 is incorporated into this embodiment. The carbide bolster 201*r* is formed in two segments to allow insertion of an other end 250*r* of a shaft 301*r* through the carbide bolster 201*r* opposite a base end 203*r* of the carbide bolster 201*r*. The shaft 301*r* includes a shaft diameter 2022 and an inserted end diameter 2021 with a portion 2023 having an diameter 2023*a* greater than the shaft diameter 2022 and less than the inserted end diameter 2021 disposed between the shaft diameter 2022 and the inserted end diameter 2021. The portion 2023 interlocks with the lip 2002 of the first segment 2000*a*. The second segment 2001*a* of the carbide bolster 201 is brazed to the first segment 2000*a* after inserted end 204*r* is in place. Both the first segment 2000*a* and the second segment 2002 are made of similar materials reducing thermal stresses that are common in traditional picks.

In some embodiments, the second carbide segment 2001*a* overhangs the first segment 2000*a*, directing debris away from a braze joint 2005 during a milling operation.

The interface between the lip 2002 of the carbide bolster 201*r* and the inserted end 204*r* of the shaft 301*r* in some embodiments forms a joint that allows the inserted end 204*r* to swivel within a cavity 307*r*. This reduces the transfer of stress induced in the carbide bolster 201*r* during a bending moment to the shaft 301*r*.

In some embodiments, the shaft 301*r* may be casted, brazed, bonded, or combinations thereof in the cavity 307*r* after insertion. In some embodiments, the inserted end 204*r* may be brazed in place while the first bolster segment 2000*a* and the second bolster segment 2001*a* are brazed together. In other embodiments, while brazing the first segment 2000*a* and the second segment 2001*a* together the flow of the braze material is controlled to prevent the braze material from interfering with the shaft 301*r*. In some embodiments, the inserted end 204*r* of the shaft 301*r* is coated with boron nitride or another non-wetting agent to prevent the braze material from bonding to the inserted end 204*r* of the shaft 301*r*.

In some embodiments, the first segment 2000*a* and the second segment 2001*a* may be made of different carbide grades. The first segment 2000*a* may comprise a more wear resistant carbide grade while the second segment 2001*a* may comprise a tougher grade or vice versa.

Figure 20:
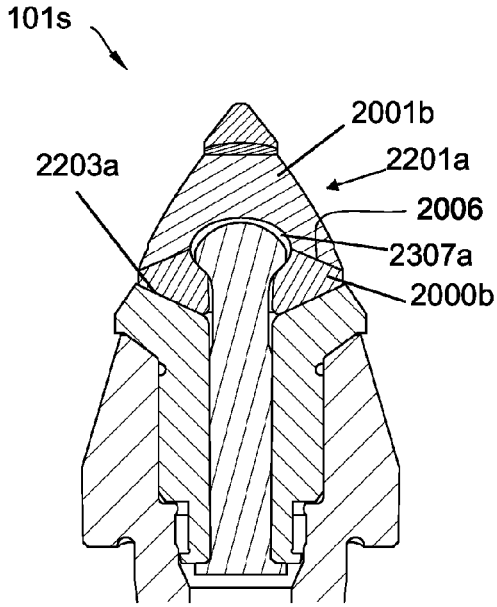
FIG. 20 is a cross-sectional diagram of another embodiment of a pick.

The embodiment of FIG. 20 discloses an embodiment of a pick 101*s* that includes a carbide bolster 2201*a* including a rearward sloping braze joint 2006 between a first carbide segment 2000*b* and a second carbide segment 2001*b*. The rearward sloping braze joint 2006 extends towards a base end 2203*a* of a carbide bolster 2201*a* as the rearward sloping braze joint 2006 extends from a cavity 2307*a* of the carbide bolster 2201*b*.

Figure 21:
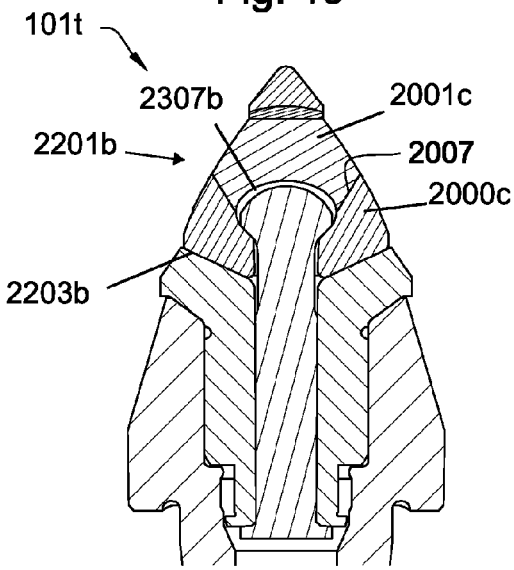
FIG. 21 is a cross-sectional diagram of another embodiment of a pick.

The embodiment of FIG. 21 discloses an embodiment of a pick 101*t* that includes a carbide bolster 2201*b* including a frontward sloping braze joint 2007 between a first carbide segment 2000*c* and a second carbide segment 2001*c* in which the frontward sloping braze joint 2007 extends away from a base end 2203*b* of the carbide bolster 2201*b* as the frontward sloping braze joint 2007 extends from a cavity 2307*b* of the carbide bolster 2201*b*.

Figure 22:
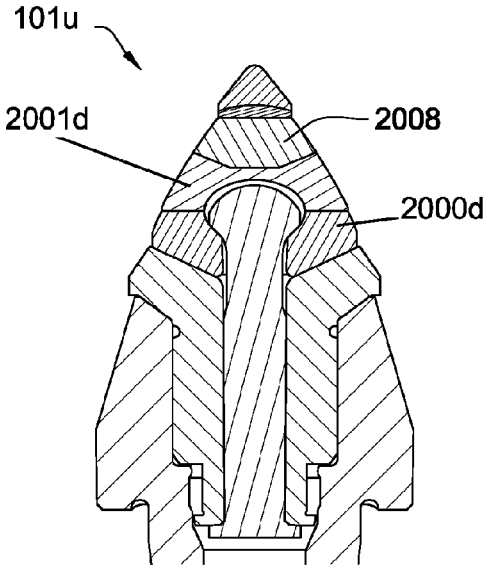
FIG. 22 is a cross-sectional diagram of another embodiment of a pick.

The embodiment of FIG. 22 discloses an embodiment of a pick 101*u* that includes a third bolster segment 2008, in addition to a first bolster segment 2000*d* and a second bolster segment 2001*d*.

Figure 23:
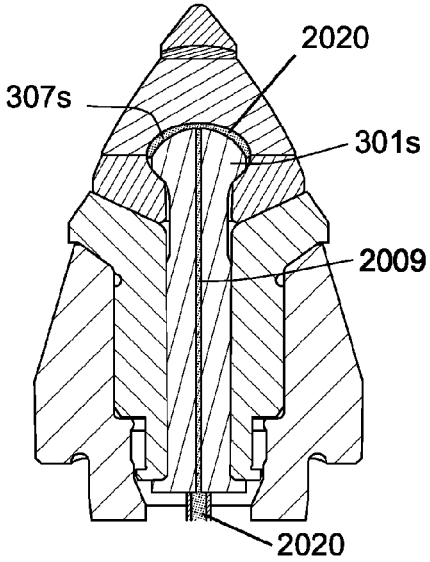
FIG. 23 is a cross-sectional diagram of another embodiment of a pick.

In some embodiments, a space within a cavity 307*s* may be lubricated. One such embodiment is disclosed in FIG. 23 where a port 2009 is formed in a shaft 301*s* to accommodate a flow of lubricant 2020 from a lubricant reservoir to the cavity 307*s*.

Figure 24:
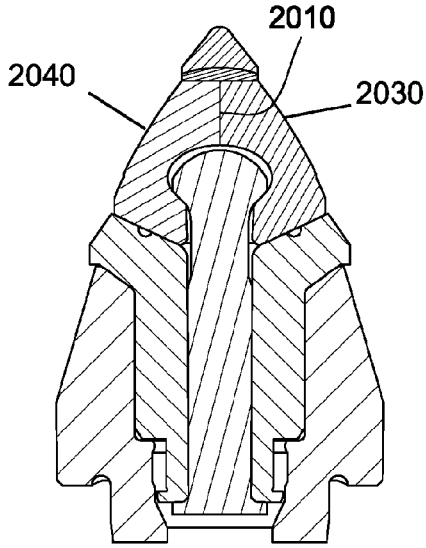
FIG. 24 is a cross-sectional diagram of another embodiment of a pick.

FIG. 24 discloses an embodiment in which a first carbide segment 2030 and a second carbide segment 2040 are bonded to one another along an axial braze joint 2010.

Figure 25:
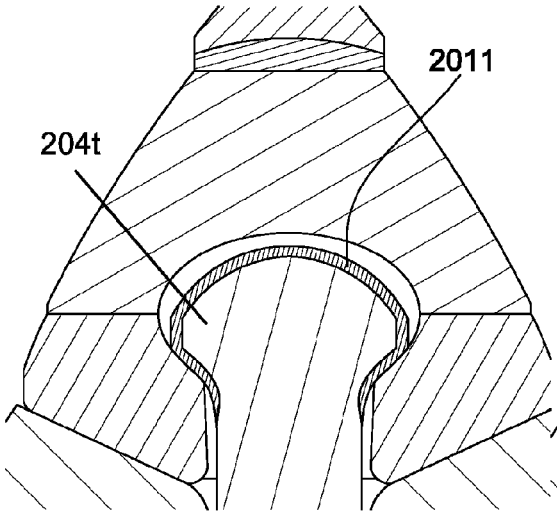
FIG. 25 is a cross-sectional diagram of another embodiment of a pick.

FIG. 25 discloses a wear resistant coating 2011 deposited on an inserted end 204*t* to prevent wear.

Figure 26:
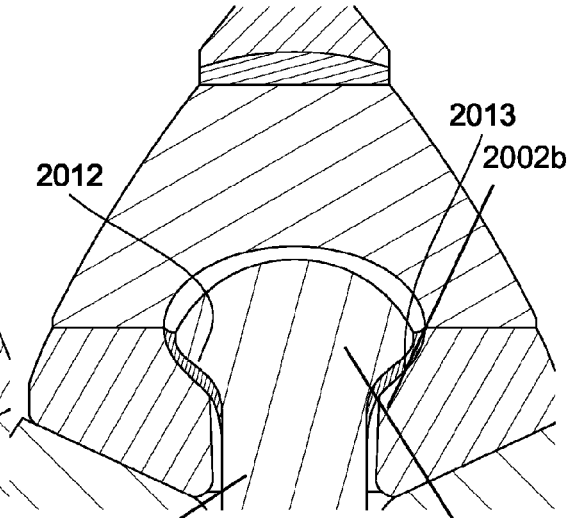
FIG. 26 is a cross-sectional diagram of another embodiment of a pick.

FIG. 26 discloses an embodiment including a braze joint 2012 between a lip 2002*b* and an underside 2013 of an inserted end 204*u* of a shaft 301*u*.

Figure 27:
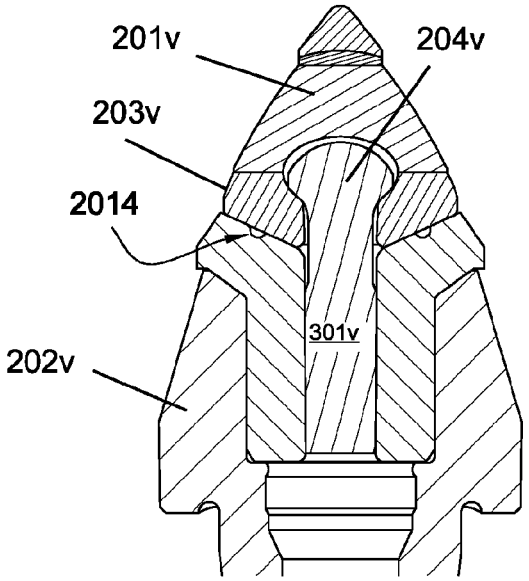
FIG. 27 is a cross-sectional diagram of another embodiment of a pick.

FIG. 27 discloses an embodiment in which a bolster 201*v* is adapted to rotate around an inserted end 204*v* of a shaft 301*v*. In such embodiments, an o-ring 2014 may be placed between a hollow shank 202*v* and a base end 203*v* of the bolster 201*v*. The shaft 301*v* may be press fit into the hollow shank 202*v*. In some embodiments a shaft may protrude out of a solid shank (not shown). Wear resistant material and lubricants may be applied to the rotating surfaces. In FIG. 27, the shaft 301*v* is press fit within the hollow shank 202*v*.

Figure 28:
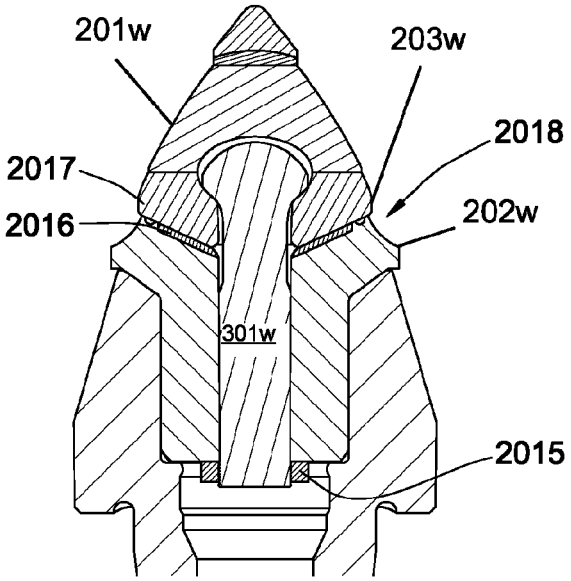
FIG. 28 is a cross-sectional diagram of another embodiment of a pick.

The embodiment of FIG. 28 illustrates a shaft 301*w* that is tensioned and secured through a threaded nut 2015 on a loaded end 251*w* of a hollow shank 202*w*. A hardened washer 2016 is attached to the hollow shank 202*w* abutting a base end 203*w* of a bolster 201*w* to provide a bearing surface on which the bolster 201*w* may rotate. The bolster 201*w* also forms an overhang 2017 over the hollow shank 202*w* to direct debris away from the rotating interface 2018.

Figure 29:
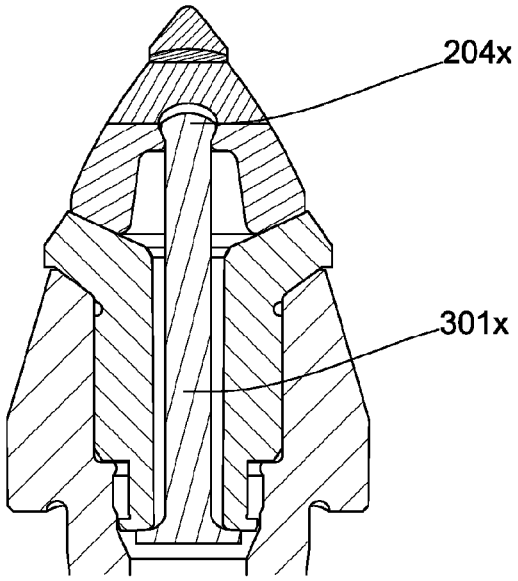
FIG. 29 is a cross-sectional diagram of another embodiment of a pick.

FIG. 29 is another embodiment of a segmented bolster 201*x* with an inserted end 204*x* of a shank 301*x* cast in place.

Figure 30:
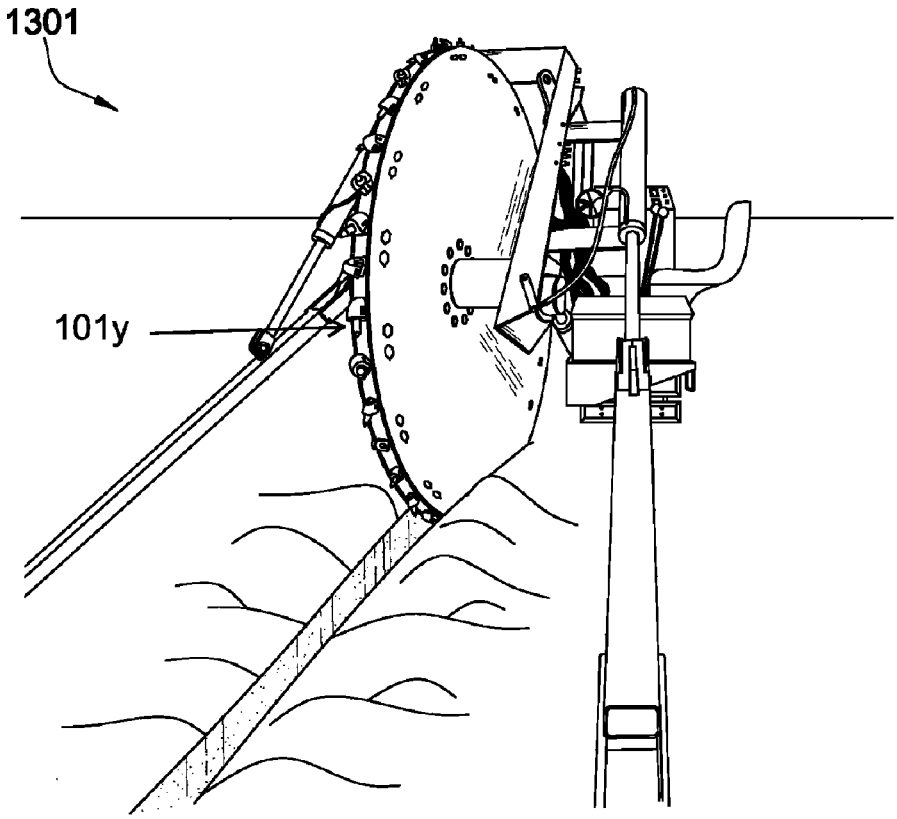
FIG. 30 is a cross-sectional diagram of an embodiment of a trencher.

FIG. 30 is a perspective diagram of an embodiment of a pick 101*y*, such as pick 101 of FIG. 1, on a rock wheel trenching machine 1301.

Figure 31:
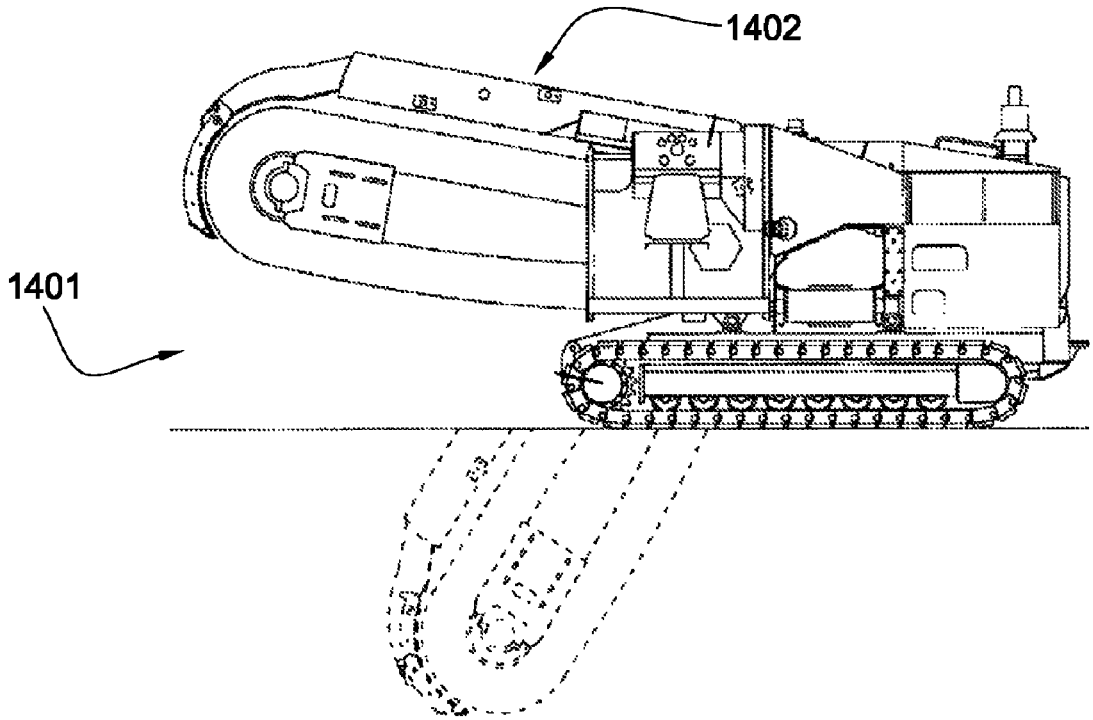
FIG. 31 is a cross-sectional diagram of another embodiment of a trencher.

FIG. 31 discloses an embodiment of a pick, such as pick 101 of FIG. 1 on a chain trenching machine 1401. The pick may be placed on a chain that rotates around an arm 1402 of the chain trenching machine 1401.

Figure 32:
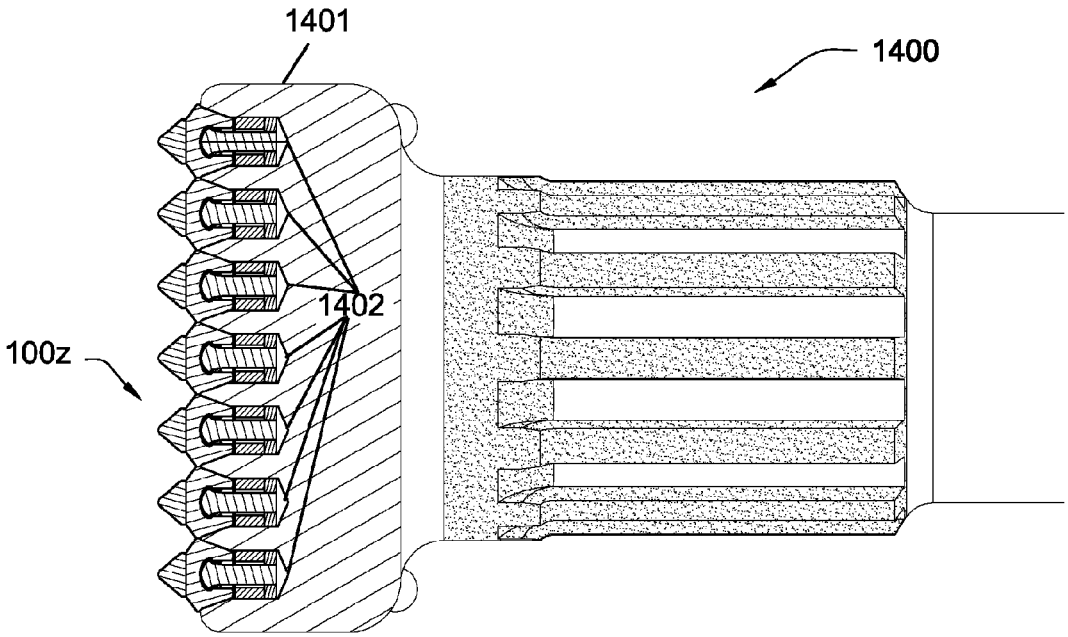
FIG. 32 is a cross-sectional diagram of an embodiment of a percussion bit.

In FIG. 32, a cross-sectional diagram of an embodiment of a percussion bit 1400 having a bit body 1401 with slots 1402 for receiving picks 101*z*. The picks 101*z* may be anchored in the slots 1402 through a press fit, barbs, hooks, snap rings, or combinations thereof.

Figure 33:
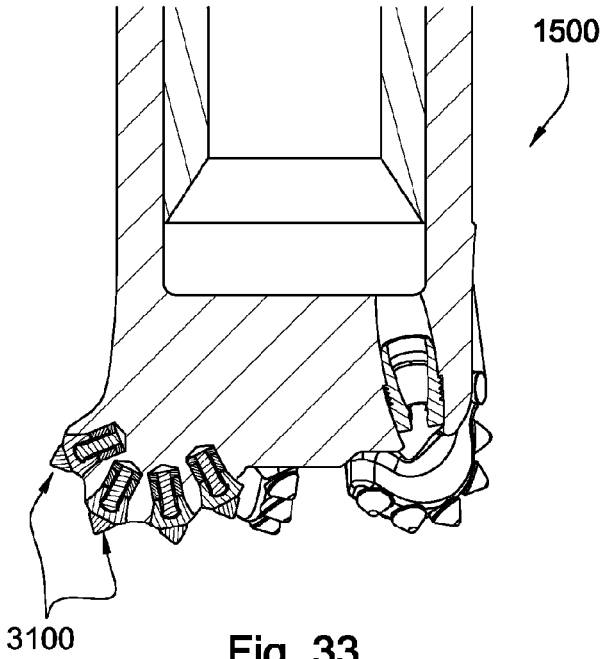
FIG. 33 is a cross-sectional diagram of an embodiment of a fixed cutter bit.

FIG. 33 discloses another embodiment with picks 3100 in a fixed cutter bit 1500.

Figure 34:
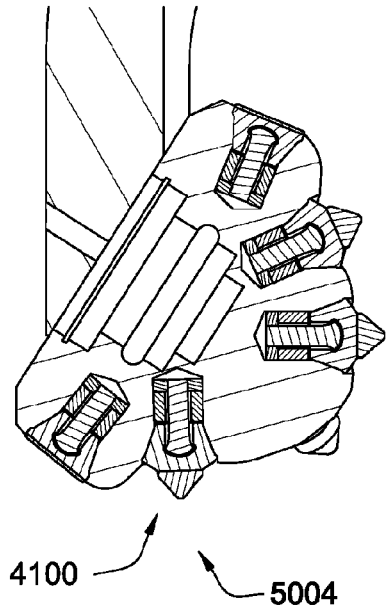
FIG. 34 is a cross-sectional diagram of an embodiment of a roller cone.

FIG. 34 discloses another embodiment with picks 4100 in a cone 5004 of a roller cone bit.

Figure 35:
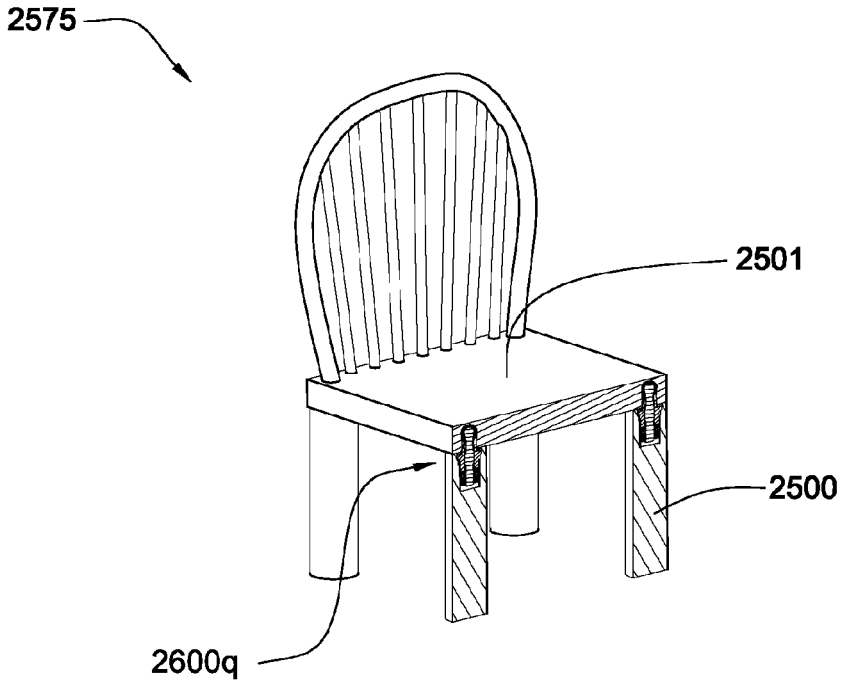
FIG. 35 is a cross-sectional diagram of another embodiment of a retention assembly.

FIG. 35 is a cross-sectional diagram of another embodiment of the retention assembly. The retention assembly 2600*a* may be used to bring two parts together, such as two parts 2500 and 2501 of a chair.

Figure 36:
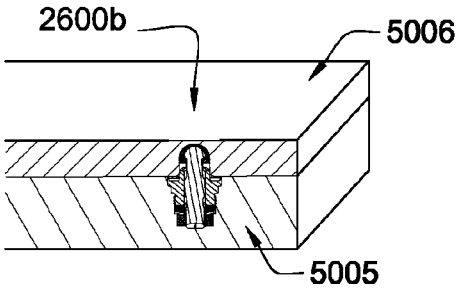
FIG. 36 is a cross-sectional diagram of another embodiment of a retention assembly.

Referring now to FIG. 36, a retention assembly 2006*b* may be used to connect two blocks 5005 and 5006 together.

Figure 37:
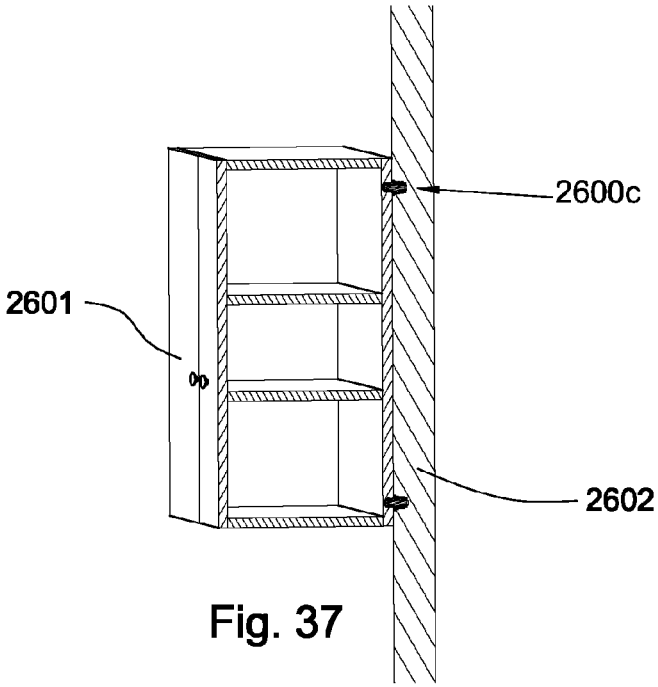
FIG. 37 is a cross-sectional diagram of another embodiment of a retention assembly.

In FIG. 37 a retention assembly 2006*c* may be used to attach a block 2601 with the other block 2602.

Whereas the present invention has been described in particular relation to the drawings attached hereto, it should be understood that other and further modifications apart from those shown or suggested herein, may be made within the scope and spirit of the present invention.

What is claimed is:

1. A retention assembly, comprising:

a carbide bolster including:

a first carbide bolster segment, said first carbide bolster segment including a base end having a cavity with an opening and a lip;

a second carbide bolster segment coupled to said first carbide bolster segment opposite said base end, said second carbide bolster segment forming a ceiling of said cavity and said second carbide bolster segment including an interface for coupling to an impact tip; and a shaft having a shaft diameter, said shaft including:

an inserted end having an inserted end diameter, said inserted end being disposed within said cavity;

an other end spaced apart from said inserted end; and, a portion between said other end and said inserted end, said portion having a diameter greater than said shaft diameter and less than said inserted end diameter, said portion being coupled to said lip of said cavity.

2. The retention assembly of claim 1, further comprising a hollow shank, said hollow shank including a first end contacting said first carbide bolster segment a loaded end in mechanical communication with said other end of said shaft, and a through bore extending from said first end to said loaded end, said shaft being disposed within said through bore.

3. The retention assembly of claim 2, wherein said shaft is configured to rotate within said through bore of said hollow shank.

4. The retention assembly of claim 1, wherein said first segment and said second segment are brazed at a rearward sloping braze extending toward said base end.

5. The retention assembly of claim 1, wherein said first segment and said second segment are brazed at a forward sloping braze extending away from said base end.

6. The retention assembly of claim 1, wherein said cavity is lubricated through a port formed in said shaft.

7. The retention assembly of claim 1, wherein said first segment and said second segment are joined together through a substantially axial braze joint.

8. The retention assembly of claim 1, wherein said inserted end is adapted to swivel within said cavity.

9. The retention assembly of claim 1, wherein a braze non-wetting agent is applied to a surface of said inserted end.

10. The retention assembly of claim 1, wherein said inserted end is brazed to said cavity.

11. The retention assembly of claim 1, wherein said inserted end is cast within said cavity.

12. The retention assembly of claim 2, wherein said carbide bolster is adapted to rotate about said inserted end of said shaft, said shaft being rigidly secured within said hollow shank, said hollow shank being configured for attachment to a driving mechanism.

13. The retention assembly of claim 12, wherein a hardened washer is disposed between an interface between said hollow shank and said carbide bolster.

14. The retention assembly of claim 12, wherein said bolster forms an overhang over said hollow shank.

15. The retention assembly of claim 12, wherein said shaft is press fit within said hollow shank.

16. The retention assembly of claim 1, wherein said second carbide bolster segment forms an overhang over said first carbide bolster segment.

17. The retention assembly of claim 2, wherein said assembly is adapted for attachment to an item selected from the group consisting of pavement milling machine, trencher, a mining machine, drill bit, a fixed cutter bit, a roller cone bit, and a percussion bit.

18. The retention assembly of claim 1 further comprising an impact tip disposed at said interface for coupling to an impact tip, said impact tip including a carbide substrate bonded to said second carbide segment and sintered diamond bonded to said carbide substrate.

19. The retention assembly of claim 8, wherein said inserted end and said cavity form a ball and socket joint.

20. The retention assembly of claim 2, further comprising a bearing surface disposed between said bolster and said shank upon which said bolster rotates.

21. A retention assembly, comprising:

a shank having a first shank end, a second shank end, and a through bore;

a bolster including:

a first bolster segment that includes a base end disposed adjacent to said first shank end, said first bolster segment including a cavity having an opening and a lip disposed therein; and a second bolster segment coupled to said first bolster segment opposite said base end, the second bolster segment forming a ceiling of said cavity and said second bolster segment including an interface for coupling to an impact tip; and a shaft having a shaft diameter disposed within with said through bore of said shank, said shaft including:

a first shaft end disposed coupled to said second shank end;

a second shaft end having a second shaft end diameter, said second shaft end disposed within said cavity; and, a portion between said first shaft end and said second shaft end, said portion having a diameter greater than said shaft diameter and less than said second shaft end diameter, said portion being at least partly retained within said cavity by said lip.

* * * * *